US006595790B1

(12) United States Patent
Bigotto

(10) Patent No.: US 6,595,790 B1
(45) Date of Patent: Jul. 22, 2003

(54) ELECTRIC CONNECTING UNIT

(75) Inventor: Pier Carlo Bigotto, Cascine Vica-Rivoli (IT)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/672,465

(22) Filed: Sep. 28, 2000

Related U.S. Application Data

(63) Continuation of application No. PCT/EP99/02162, filed on Mar. 29, 1999.

(30) Foreign Application Priority Data

Mar. 31, 1998 (IT) ..... TO98A0287

(51) Int. Cl.[7] ..... H01R 13/62
(52) U.S. Cl. ..... 439/157; 439/347
(58) Field of Search ..... 439/157, 152–156, 439/372, 310, 595, 466, 347

(56) References Cited

U.S. PATENT DOCUMENTS 5,575,676 A * 11/1996 Tsukakoshi et al. ..... 439/347
5,681,184 A * 10/1997 Pamart et al. ..... 439/595
5,823,807 A * 10/1998 Yamasaki et al. ..... 439/157
5,899,762 A * 5/1999 Ainceri ..... 439/157
5,928,011 A * 7/1999 Flask et al. ..... 439/157
5,928,013 A * 7/1999 Iwahori ..... 439/347
6,062,882 A * 5/2000 Hanazaki et al. ..... 439/157

FOREIGN PATENT DOCUMENTS

DE 3709461 A1 10/1987
DE 19509336 A1 9/1995
DE 19532623 A1 3/1997
GB 2055255 A 2/1981

* cited by examiner

*Primary Examiner*—P. Austin Bradley
*Assistant Examiner*—Phuong Nguyen
(74) *Attorney, Agent, or Firm*—Perman & Green, LLP

(57) ABSTRACT

An electric connecting unit (1) having a pair of electric connectors (3, 4), one (3) of which is fittable to a supporting member (2), and which are connectable mutually along a longitudinal axis (A) and each comprise an insulating enclosure (5, 20) defining a number of longitudinal cavities (6, 21) for respective electric terminals (7, 22). The unit (1) also has a locking member (35) carried by, and movable with respect to, a first (20) of the enclosures in a transverse direction (B) crosswise to the longitudinal axis A) to connect respective substantially cylindrical mating portions (18, 25) of the enclosures (5, 20) in a lock position; and cam means (36)interposed between the locking member (35) and a second (5) of the enclosures to grip the connectors (3, 4) along the longitudinal axis (A) as the locking member (35) moves in the transverse direction (B).

23 Claims, 3 Drawing Sheets

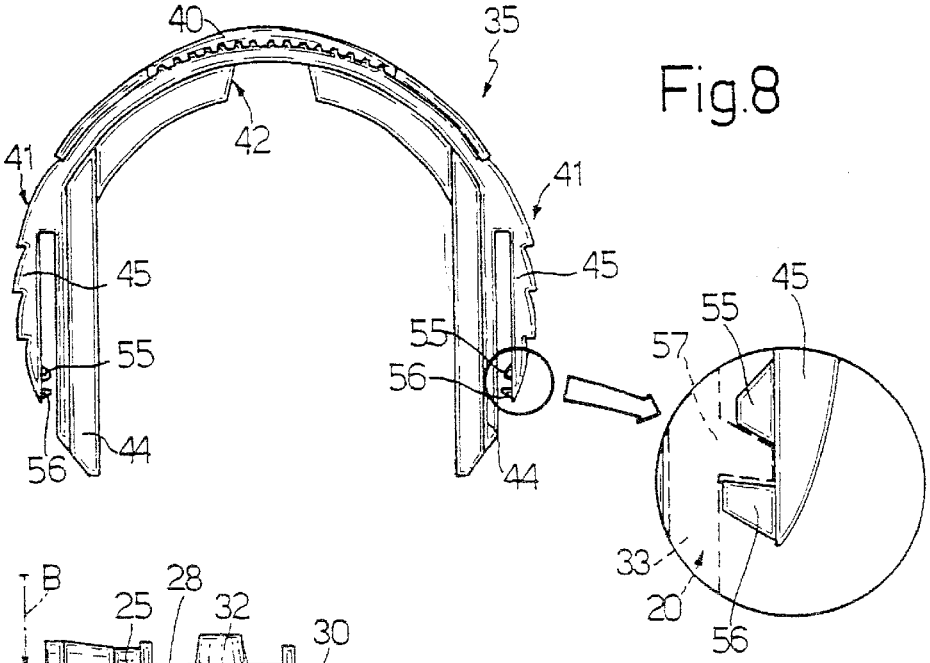
Fig.8
Fig.9
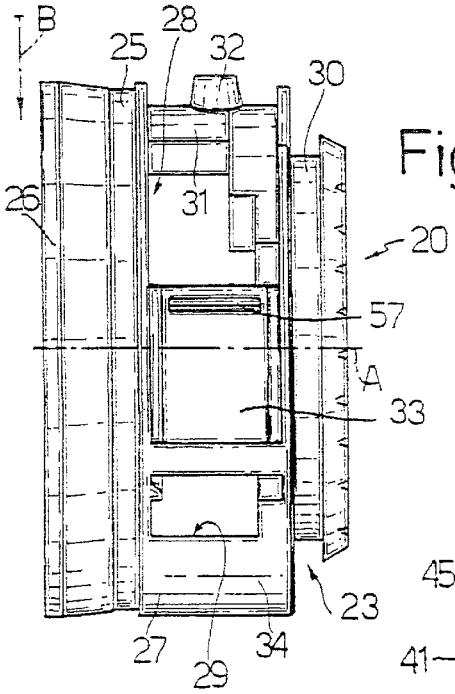
Fig.7
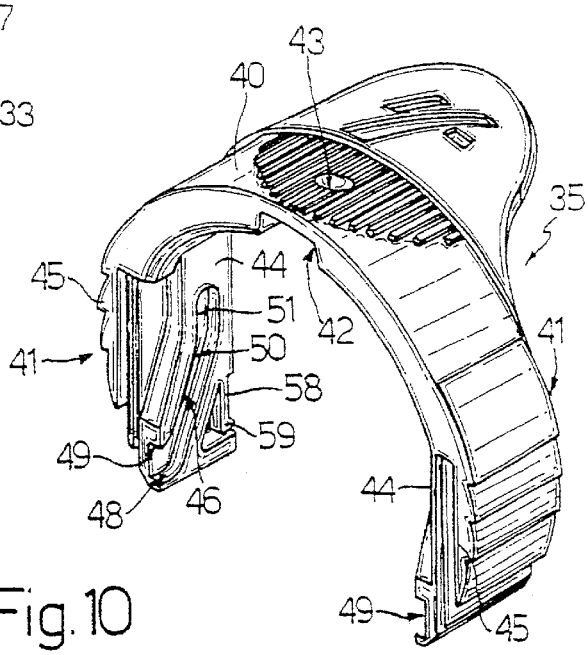
Fig.10

ELECTRIC CONNECTING UNIT

This application is a Continuation of pending International Application No. PCT/EP99/02162 filed on Mar. 29, 1999.

TECHNICAL FIELD

The present invention relates to an automotive electric connecting unit, and in particular to a fit-through connecting unit normally used to connect electric devices located on opposite sides of a dividing wall.

BACKGROUND ART

Electric connecting units of the above type are known, which are substantially circular and substantially comprise a first connector fittable to and extending through the dividing wall, and a circular second connector which clicks onto the first connector into a lock position along a longitudinal axis perpendicular to the dividing wall.

Each connector normally comprises an insulating enclosure having a number of longitudinal cavities, and a number of electric terminals housed inside respective cavities and connected to respective electric cables forming a bundle extending from the connector. More specifically, the electric terminals of the first connector are complementary to and mate with the electric terminals of the second connector when the connectors are in the lock position.

To ensure correct insertion and reduce the coupling force required, the two connectors are normally fastened by means of an auxiliary, e.g. bayonet type, retaining device, which substantially comprises a lock ring fitted in rotary and axially-fixed manner to the outside of the enclosure of one of the two connectors and having a radial tooth which engages a groove tapering in section and formed on the outer surface of the enclosure of the other connector.

Connecting units of this sort are often fitted in parts of vehicles that are hard to reach, in which case, the lock ring is fairly difficult to rotate. Moreover, since correct coupling of the connectors calls for exactly determining beforehand the angular position of the lock ring with respect of the connector with the groove, correct positioning of the two connectors is fairly awkward, and manipulating the connectors in search of the correct position very often results in damage to the terminals.

DISCLOSURE OF INVENTION

It is an object of the present invention to provide an electric connecting unit designed to eliminate, in a straightforward, reliable manner, the aforementioned drawbacks typically associated with known units.

According to the present invention, there is provided an electric connecting unit comprising:

a pair of electric connectors mutually connectable along a longitudinal axis, and each comprising an insulating enclosure defining a number of longitudinal cavities for respective electric terminals connectable to corresponding electric terminals of the other said connector; and connecting means for connecting respective substantially cylindrical mating portions of said enclosures in a lock position locking said connectors;

characterized in that said connecting means comprise a locking member carried by, and movable with respect to, the first of said enclosures in a transverse direction crosswise to said longitudinal axis; and cam means interposed between said locking member and a second of said enclosures to grip said connectors along said longitudinal axis as said locking member moves in said transverse direction.

BRIEF DESCRIPTION OF DRAWINGS

A preferred, non-limiting embodiment of the present invention will be described by way of example with reference to the accompanying drawings, in which:

FIG. 7 shows a smaller-scale side view of the FIG. 6 connector with parts removed for clarity;

FIG. 8 shows a smaller-scale front view of a detail of the FIG. 5 connector;

FIG. 9 shows a larger-scale front view of a detail in FIG. 8;

FIG. 10 shows a view in perspective of the FIG. 8 detail.

BEST MODE FOR CARRYING OUT THE INVENTION

Figure 2:
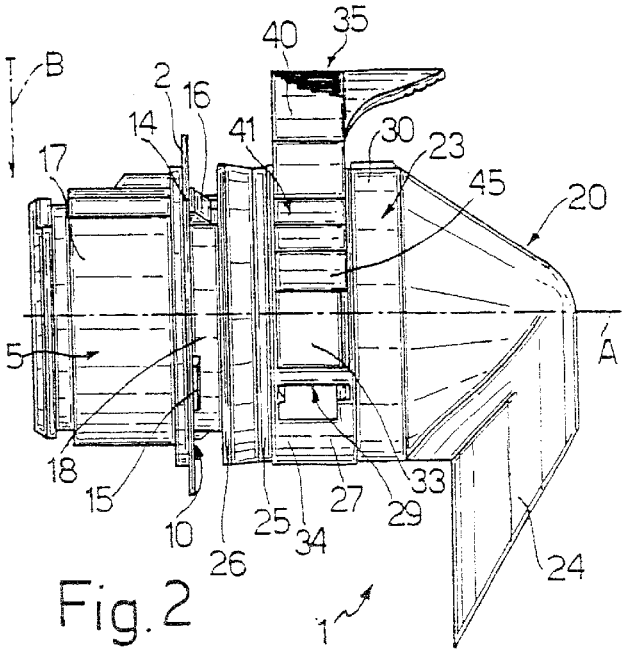
FIG. 2 shows a side view of the FIG. 1 unit in a preassembly position.
Figure 1:
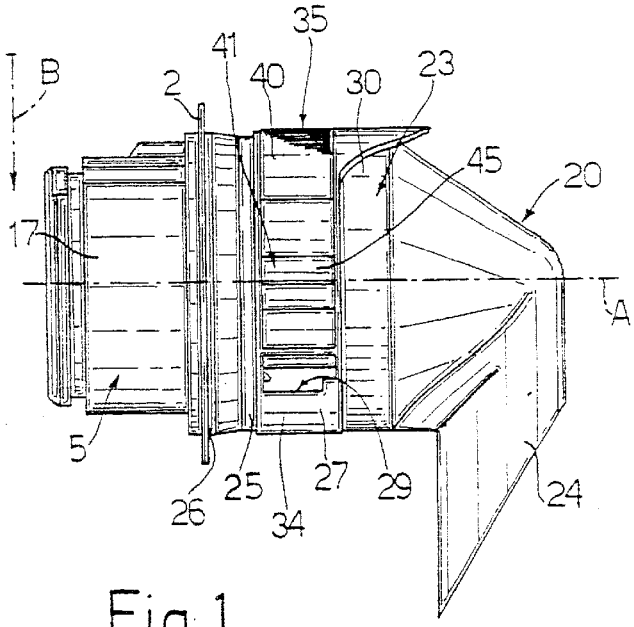
FIG. 1 shows a side view of an electric connecting unit in accordance with the present invention.

With reference to FIGS. 1 and 2, number 1 indicates as a whole an automotive fit-through electric connecting unit for connecting electric devices (not shown) located on opposite sides of a substantially flat dividing wall 2.

Unit 1 substantially comprises two electric connectors 3, 4 mutually connectable in a lock position along a longitudinal axis A perpendicular to wall 2.

Figure 5:
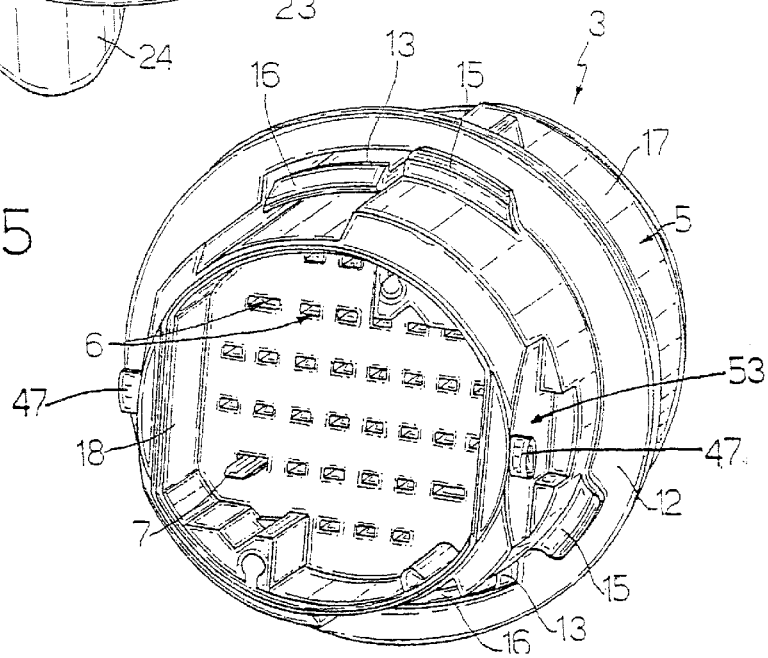
FIG. 5 shows a larger-scale view in perspective of a first connector of the FIG. 1 unit.

With reference to FIGS. 1, 2 and 5, connector 3 is fitted to wall 2, and comprises a substantially cylindrical insulating enclosure 5, of axis A, defining a number of longitudinal cavities 6; and a number of male blade-type electric terminals 7 connected to respective known electric cables (not shown), and which are housed and retained inside respective cavities 6 by respective known elastic retaining lances (not shown).

More specifically, enclosure 5 engages a circular through hole 10 in wall 2, and comprises an outer annular flange 12 which, in use, rests against wall 2; a pair of elastic retaining lances 13 spaced angularly about axis A and which click onto a peripheral edge 14 of hole 10 to secure enclosure 5 axially to wall 2; and a number of radial projections 15 which, in use, engage respective seats (not shown) formed in peripheral edge 14 to prevent connector 3 from rotating either way with respect to wall 2. More specifically, each lance 13 projects longitudinally from an outer surface of enclosure 5, and comprises, on the free end, a retaining tooth 16 having a profile substantially in the form of a rectangular trapezium, and which clicks onto the peripheral edge 14 of hole 10.

Enclosure 5 also comprise a rear portion 17 having cavities 6 for terminals 7, and from which flange 12, lances 13 and projections 15 extend outwards; and a hollow front portion 18 projecting axially from hole 10, on the opposite side to flange 12, and housing the contact portions of terminals 7.

With reference to FIGS. 1, 2, 6 and 7, connector 4 comprises an insulating enclosure 20 connectable along axis A to enclosure 5, and defining a number of longitudinal cavities 21; and a number of female electric terminals 22, which are connected to respective known electric cables (not shown), are housed and retained inside respective cavities 21 by respective known elastic retaining lances (not shown), and mate with corresponding terminals 7 of connector 3.

More specifically, enclosure 20 comprises a substantially cylindrical main portion 23, of axis A, having cavities 21 for terminals 22 and which mates in sliding manner with front portion 18 of enclosure 5; and a hollow secondary portion 24, which is substantially L-shaped when viewed from the side and is fitted through with said electric cables.

More specifically, main portion 23 of enclosure 20 comprises a hollow cylindrical front portion 25 communicating with cavities 21 and which is engaged, in the lock position of connectors 3 and 4, by front portion 18 of enclosure 5. The front end of portion 25 of enclosure 20 is fitted with a peripheral rubber ring 26, which, in the lock position of connectors 3 and 4, rests against wall 2, on the opposite side to flange 12 of enclosure 5.

Main portion 23 of enclosure 20 also comprises a substantially cylindrical intermediate portion 27 having two pairs of lateral, substantially rectangular through openings 28, 29 for the purpose explained later on; and a cylindrical rear portion 30 extending between portion 27 and secondary portion 24.

More specifically, openings 28 define on portion 27 a substantially square top wall 31 supporting a radially-outward-projecting, truncated-cone-shaped pin 32, and are defined on opposite sides by respective flat lateral walls 33 of portion 27, located on diametrically opposite sides of axis A. Portion 27 also comprises a curved wall 34 opposite wall 31, and which is longer circumferentially than wall 31 and, together with respective lateral walls 33, defines openings 29.

According to the present invention, unit 1 also comprises a substantially U-shaped locking member 35 fitted to portion 27 of enclosure 20 so as to slide in a direction B perpendicular to axis A and parallel to lateral walls 33 of portion 27; and cam means 36 interposed between locking member 35 and portion 27 of enclosure 20 to grip connectors 3 and 4 along axis A as locking member 35 moves in direction B.

With particular reference to FIGS. 8 to 10, locking member 35 comprises a curved, arc-shaped portion 40, which contacts wall 31 of portion 27 of enclosure 20 in the lock position of connectors 3 and 4, and from the opposite ends of which extend respective substantially straight, parallel lateral portions 41 which cooperate in sliding manner with respective lateral walls 33 of portion 27.

More specifically, curved portion 40 comprises, at the top, a substantially square recess 42 and a circular through hole 43, which, in the lock position of connectors 3 and 4, are engaged respectively by wall 31 of portion 27 of enclosure 20 and by pin 32. Each lateral portion 41 is defined by a pair of walls 44, 45 extending parallel to each other from the relative end of curved portion 40, and which respectively cooperate in sliding manner with opposite inner and outer faces of relative lateral wall 33 of portion 27 of enclosure 20. More specifically, each wall 45 is located on the opposite side of enclosure 20 to respective wall 44.

Locking member 35 is movable, with respect to enclosure 20, between a preassembly position—wherein curved portion 40 is detached from wall 31 of portion 27, and walls 44 engage engage respective openings 28 of portions 27 and are located partly inside enclosure 20—and a final assembly position corresponding to the lock position of connectors 3 and 4, and wherein recess 42 and hole 43 of curved portion 40 are engaged respectively by wall 31 of portion 27 and by pin 32, and each wall 44 engages both respective openings 28 and 29. More specifically, engagement of hole 43 by pin 32 shows locking member 35 is in the final assembly position and, therefore, connectors 3 and 4 in the lock position.

Figure 4:
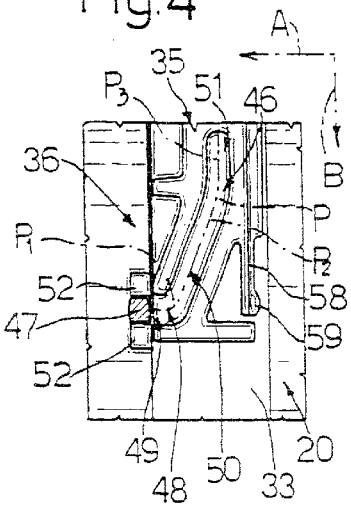
FIG. 4 shows a larger-scale longitudinal section of a detail of the FIG. 2 unit.
Figure 3:
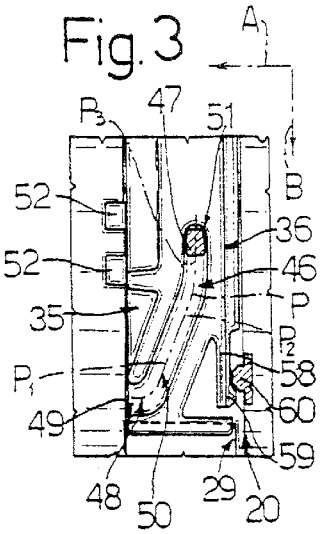
FIG. 3 shows a larger-scale longitudinal section of a detail of the FIG. 1 unit.
Figure 6:
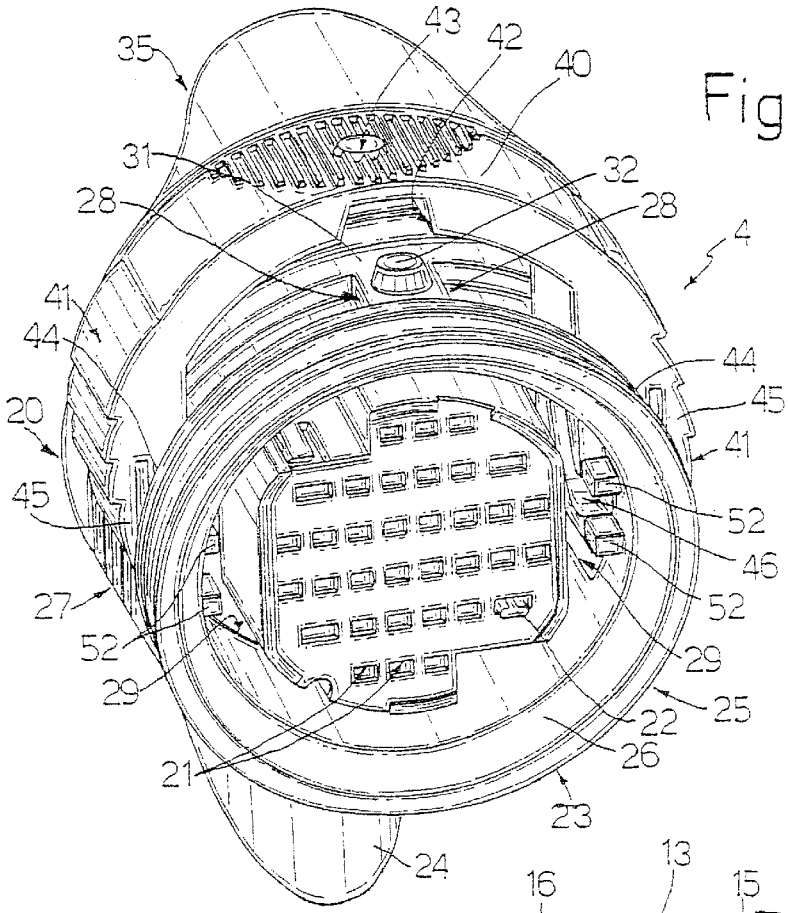
FIG. 6 shows a larger-scale view in perspective of a second connector of the FIG. 1 unit.

With reference to FIGS. 3, 4 and 10, cam means 36 comprise, for each lateral portion 41 of locking member 35, a shaped oblique slot 46 formed in the surface of respective wall 44 facing inwards of enclosure 20; and a pin 47 projecting outwards from portion 18 of enclosure 5, and which engages slot 46 in sliding manner as locking member 35 moves between the preassembly and final assembly positions.

More specifically, each slot 46 defines, for respective pin 47, a guide path P defined by an initial portion P1 parallel to axis A; an intermediate portion P2 sloping with respect to, and lying in the plane defined by, axis A and direction B; and an end portion P3 parallel to direction B. Each slot 46 comprises an inlet portion 48, for respective pin 47, defining portion P1 of path P and communicating laterally with the outside through a respective opening 49; an intermediate portion 50 defining portion P2 of path P; and an end portion 51 defining portion P3 of path P and having a U-shaped outer contour. Portions 48, 50 and 51 are preferably connected continuously to one another to grip connectors 3 and 4 gradually and compensate for the nonlinear increase in the coupling force produced by compressing rubber ring 26 against wall 2.

Front portion 25 of enclosure 20 comprises, internally and close to each lateral wall 33 of portion 27, a pair of projections 52, which, in the preassembly position of locking member 35, are aligned with the edge of opening 49 of relative slot 46 of locking member 35 to guide relative pin 47 inside slot 46.

Pins 47 are located on diametrically opposite sides of axis A, and each project from a bottom surface of a respective shaped recess 53 formed externally along the lateral surface of front portion 18 of enclosure 5. More specifically, each pin 47 is located close to the front end of enclosure 5, and respective recess 53 extends, parallel to axis A and towards flange 12, by an amount sufficient to enable respective projections 52 of enclosure 20 to move with respect to enclosure 5 in a direction parallel to axis A when gripping connectors 3 and 4.

With reference to FIGS. 3, 4 and 10, each wall 45 of locking member 35 comprises, at the free end, a pair of substantially trapezoidal teeth 55, 56, which project towards relative lateral wall 33 of enclosure 20, are aligned with each other in direction B, and cooperate on opposite sides with a tooth 57 on lateral wall 33 to define the preassembly position of locking member 35 on enclosure 20. More specifically, each tooth 57 projects outwards from respective lateral wall 33, and is located adjacent to respective opening 28.

Finally, each wall 44 of locking member 35 comprises, on the side facing secondary portion 24 of enclosure 20, an elastic lance 58 projecting longitudinally from a recess in wall 44 and having, at the free end, an isosceles-trapezium-shaped tooth 59 which clicks onto a similarly shaped tooth 60 projecting inwards from portion 30 of enclosure 20 to define the final assembly position of locking member 35 on enclosure 20.

Unit 1 is assembled as described below, commencing from an initial condition in which connector 3 is fitted to wall 2, locking member 35 is fitted to the main portion of connector 4 in the preassembly position, and terminals 7, 22 are housed inside respective cavities 6, 21 of connectors 3, 4 (FIG. 2).

As of the above condition, connector 4 is moved along axis A towards connector 3 until main portion 23 is engaged by front portion 18 of enclosure 5 of connector 3. In the course of the above operation, pins 47 of enclosure 5 are inserted easily inside inlet portions 48 of respective slots 46 by virtue of the guiding action of respective pairs of projections 52 on enclosure 20 (FIG. 4).

At this point, locking member 35 is pushed in direction B into the final assembly position, sot hat each pair of teeth 55, 56 releases tooth 57 of respective lateral wall 33, and walls 44 and 45 slide along opposite faces of lateral walls 33. At the same time, pins 47 slide inside oblique intermediate portions 50 of respective slots 46 so that, as locking member 35 moves in direction B, enclosure 20 moves in direction A towards wall 2 to grip connectors 3 and 4 in the same direction.

Pins 47 then move on into end portions 51 of respective slots 46, so that teeth 59 of elastic lances 58 of walls 44 click onto respective teeth 60 of portion 30 of enclosure 20 to define the final assembly position of locking member 35 on enclosure 20 and, therefore, the lock position of connectors 3 and 4 (FIGS. 1 and 3). The oblique trapezoidal profile of teeth 59, 60 provides, when necessary, for releasing locking member 35 from the final assembly position on enclosure 20 and so disconnecting connectors 3 and 4.

In particular, locking member 35 provides, during assembly, for foolproof location of the relative angular position in which to connect connector 4 to connector 3, thus avoiding—particularly when connecting unit 1 is fitted in a poorly accessible part of the vehicle—repeated juggling of connector 4 in an attempt to locate the correct position, and the consequent risk of damage to terminals 7, 22. Moreover, in the case of limited access, the translatory movement of locking member 35 is obviously far simpler than the rotary movements called for by the known connecting units described previously.

Clearly, changes may be made to electric connecting unit 1 without, however, departing from the scope of the present invention.

What is claimed is:

1. An electric connecting unit comprising:

a pair of electric connectors mutually connectable along a longitudinal axis, and each comprising an insulating enclosure defining a number of longitudinal cavities for respective electric terminals connectable to corresponding electric terminals of the other of the connectors; and connecting means for connecting respective substantially cylindrical mating portions of the enclosures in a lock position locking the connectors;

wherein the connecting means comprise a locking member carried by, and movable with respect to, a first of the enclosures in a transverse direction crosswise to the longitudinal axis; and cam means interposed between the locking member and a second of the enclosures to cam the connectors in and out along the longitudinal axis as the locking member moves forth and back along the transverse direction, the locking member comprising at least a pair of first walls parallel to each other and to the transverse direction, and a pair of second walls, which extend, parallel to the respective first walls, from respective ends of the connecting portion, are each located on the opposite side of the first enclosure to the respective first wall, and slide externally along the first enclosure as the locking member moves in the transverse direction further comprising first and second stop means interposed between the locking member and the first enclosure and respectively defining a preassembly position and a final assembly position of the locking member on the first enclosure, the first stop means comprising, for each of the second walls, a first tooth carried by one of the first enclosures and the second wall, and a pair of second teeth carried by the other of the first enclosure and the second wall, and which are aligned with each other in the transverse direction and cooperate on opposite sides with the first tooth to define a preassembly position of the locking member.

2. A unit as claimed in claim 1, wherein one of said connectors is fittable to a supporting member.

3. A unit as claimed in claim 1, wherein said locking member is substantially U-shaped.

4. A unit as claimed in claim 1, wherein said second stop means comprise, for each of said first walls, a third and a fourth tooth, which are carried respectively by said first enclosure and by said first wall or the respective of said second walls of said locking member, and are adapted to click onto each other to define said final assembly position of the locking member.

5. A unit as claimed in claim 4, wherein said fourth teeth are carried by respective of said first walls of said locking member; and further wherein said third teeth project inwards from said first enclosure.

6. An electric connecting unit, comprising:

a pair of electric connectors mutually connectable along a longitudinal axis and each comprising an insulating enclosure defining a number of longitudinal cavities for respective electric terminals connectable to corresponding electric terminals of the other of the connectors; and connecting means for connecting respective substantially cylindrical mating portions of the enclosure in a lock position locking the connectors;

wherein the connecting means comprise a locking member carried by, and movable with respect to, a first of the enclosures in a transverse direction crosswise to the longitudinal axis; and cam means interposed between the locking member and a second of the enclosures to grip the connectors along the longitudinal axis as said locking member moves in said transverse direction, and further wherein the locking member comprises at least a pair of first walls parallel to each other and to the transverse direction, and a pair of second walls which extend parallel to the respective first walls, and a connecting portion for connecting the first walls; and in that the cam means comprise, for each of the first walls, first engaging means carried by one of the first walls and the second enclosure, and second engaging means carried by the other of the first walls and the second enclosure and cooperating in sliding manner with the first engaging means to move the first engaging means along a path having at least one oblique portion slanting with respect to the longitudinal axis and the transverse direction, and lying in a plane defined by the longitudinal axis and the transverse direction, further comprising first and second stop means interposed between the locking member and the first enclosure and respectively defining a preassembly position and a final assembly position of the locking member on the first enclosure, the first stop means comprising, for each of the second walls, a first tooth carried by one of the first enclosure and the second wall, and a pair of second teeth carried by the other of the first enclosure and the second wall, and which are aligned with each other in the transverse direction and cooperate on opposite sides with the first tooth to define a preassembly position of the locking member.

7. A unit as claimed in claim 6, wherein said first enclosure comprises at least a pair of lateral opening by which to insert the respective said first walls of said locking member inside the first enclosure.

8. A unit as claimed in claim 7, wherein said first engaging means comprise a pair of slots formed in respective of said first walls of said locking member; and in that said second engaging means comprise a pair of pins, which project outwards from said second enclosure, are located on diametrically opposite side with respect to said longitudinal axis, and engage respective said slots in a sliding manner.

9. A unit as claimed in claim 8, wherein each of said slots comprises an inlet portion for the respective of said pin, substantially parallel to said longitudinal axis and communicating laterally with the outside through a respective opening; an intermediate portion defining said oblique portion of said path; and an end portion parallel to said transverse direction.

10. A unit as claimed in claim 9, wherein said first enclosure comprises guide means aligned with said opening of said inlet portion of each of said slots in said preassembly position of said locking member to guide said respective pin of said second enclosure into said slot.

11. A unit as claimed in claim 10, wherein said guide means comprise, for each of said first walls of said locking member, a pair of projections carried by and projecting inside said first enclosure.

12. An electric connecting unit comprising:

a pair of electric connectors mutually connectable along a longitudinal axis, and each comprising an insulating enclosure defining a number of longitudinal cavities for respective electric terminals connectable to corresponding electric terminals of the other connector; and connecting means for connecting respective substantially cylindrical mating portions of the enclosures in a lock position locking the connectors;

wherein the connecting means comprise a locking member carried by, and movable with respect to, a first of the enclosures in a transverse direction crosswise to the longitudinal axis; and cam means interposed between the locking member and a second of the enclosures to cam the connectors in and out along the longitudinal axis as the locking member moves forth and back along the transverse direction;

further comprising first and second stop means interposed between the locking member and the first enclosure and respectively defining a preassembly position and a final assembly position of the locking member on the first enclosure;

the locking member including a pair of first walls parallel to each other and to the transverse direction, a connecting portion for connecting the first walls, and a pair of second walls, which extend parallel to the respective first walls from respective ends of the connecting portion, each of the second walls being located on the opposite sides of the first enclosure to the respective first wall, and slide externally along the first enclosure as the locking member moves, wherein a portion of the first enclosure is sandwiched between the first and second pair of walls.

13. A unit as claimed in claim 12 where said locking member moves in said transverse direction; said first stop means comprising, for each of said second walls, a first tooth carried by one of said first enclosures and said second walls, and a pair of second teeth carried by the other of said first enclosures and said second wall, and which are aligned with each other in said transverse direction and cooperate on opposite sides with said first tooth to define said preassembly position of said locking member.

14. A unit as claimed in claim 12, wherein one of said connectors is fittable to a supporting member.

15. A unit as claimed in claim 12, wherein said second stop means comprise, for each of said first walls, a third and a fourth tooth, which are carried respectively by said first enclosure and by said first wall or the respective said second all of said locking member, and click onto each other to define said final assembly position of the locking member.

16. A unit as claimed in claim 15, wherein said forth teeth are carried by respective of said first walls of said locking member; and said third teeth project inwards from said first enclosure.

17. A unit as claimed in claim 12, wherein said locking member is substantially U-shaped.

18. A unit as claimed in claim 17, wherein said locking member comprises at least a pair of first walls parallel to each other and to said transverse direction, and a connecting portion for connecting the first walls; and the cam means comprise, for each of said first walls, first engaging means carried by one of said first walls and said second enclosure, and second engaging means carried by the other of said first walls and said second enclosure and cooperating in sliding manner with said first engaging means to move the first engaging means along a path having at least one oblique portion slanting with respect to said longitudinal axis and said transverse direction, and lying in a plane defined by the longitudinal axis and the transverse direction.

19. A unit as claimed in claim 18, wherein said first enclosure comprises at least a pair of lateral opening by which to insert the respective said first walls of said locking member inside the first enclosure.

20. A unit as claimed in claim 19, wherein said first engaging means comprise a pair of slots formed in respective said first walls of said locking member; and said second engaging means comprise a pair of pins, which project outwards from said second enclosure, are located on diametrically opposite sides with respect to said longitudinal axis, and engage respective said slots in a sliding manner.

21. A unit as claimed in claim 20, wherein each of said slots comprises an inlet portion for the respective pin, substantially parallel to said longitudinal axis and communicating laterally with the outside through a respective opening; an intermediate portion defining said oblique portion of said path; and an end portion parallel to said transverse direction.

22. A unit as claimed in claim 21, wherein said first enclosure comprises guide means aligned with said opening of said inlet portion of each of said slots in aid preassembly position of said locking member to guide the respective said pin of said second enclosure into said slot.

23. A unit as claimed in claim 22, wherein said guide means comprise, for each of said first walls of said locking member, a pair of projections carried by and projecting inside said first enclosure.

* * * * *